US005210932A

United States Patent [19]

Tokura

[11] Patent Number: 5,210,932

[45] Date of Patent: May 18, 1993

[54] TUBE EXPANDER

[75] Inventor: Kenji Tokura, Osaka, Japan

[73] Assignee: Kyoshin Kogyo Kabushiki Kaisha, Osaka, Japan

[21] Appl. No.: 833,248

[22] Filed: Feb. 10, 1992

[30] Foreign Application Priority Data

Oct. 4, 1991 [JP] Japan ..... 3-080913[U]

[51] Int. Cl.[5] ..... B23P 15/26

[52] U.S. Cl. ..... 29/727; 29/726; 29/890.044

[58] Field of Search ..... 29/726, 727, 890.03, 29/890.044

[56] References Cited

U.S. PATENT DOCUMENTS

| | | | |
|---|---|---|---|
| 1,339,434 | 5/1920 | Coffelder | 29/727 |
| 2,918,962 | 12/1959 | Jones | 29/726 |
| 4,216,569 | 8/1980 | Stiller et al. | 29/727 |
| 5,040,405 | 8/1991 | Honma et al. | 29/727 |
| 5,062,199 | 11/1991 | Kelly | 29/727 |

*Primary Examiner*—Irene Cuda
*Attorney, Agent, or Firm*—Jordan and Hamburg

[57] ABSTRACT

A tube expander includes an oil-discharging device for discharging a predetermined amount of oil into the tubes of a heat exchanger mounted on the tube expander which is movably mounted between tube-expanding mandrels of the tube expander and the heat exchanger. The oil-discharging device is provided with a plurality of oil-discharging nozzles each constructed of a pipe-shaped nozzle main body having an end expander bullet that can be inserted into a tube, an oil-discharging hole arranged between the nozzle main body and the expander bullet for discharging the oil, an annular sleeve mounted around the circumferential surface of the main body for reciprocal movement relative thereto, the annular sleeve having an end contact part for abutting against an opening end of the tube, the annular sleeve sealing the oil-discharging hole of the nozzle main body by means of a resilient member, and a stopper provided on an end of the expander bullet to receive the sleeve on the end of the expander bullet.

16 Claims, 7 Drawing Sheets

TUBE EXPANDER

BACKGROUND OF THE INVENTION

The present invention relates to a tube expander, and more specifically to a tube expander to be used, for example, to expand a plurality of tubes into interlocked relationship with a plurality of radiating fins which together constitute a heat exchanger.

In a tube expander 13 of conventional structure, as shown in FIG. 7, a plurality of tube-expanding mandrels 6 are inserted into a surface 5*a* of a reciprocating member 5 and fixed therein. Reciprocating member 5 is then moved upwardly and downwardly by cylinders 4 or the like. A stripper plate 7 having strippers 7*a* to determine the height of projection of the expanded tubes is provided below the reciprocating member 5. Hair pin tubes 9 arranged in a plurality of rows are inserted into a plurality of radiating fins 8 in the same direction. A heat exchanger 11 having end plates 10*a*, 10*b* placed on both ends of the radiating fins 8 with the tubes 9 inserted therein is supported by a plurality of receivers 12. Thereafter, the tubes 9 are expanded into a tight interlocked relationship with the end plates 10*a*, 10*b* and the plurality of radiating fins 8 by means of pressure applied by mandrels 6 as the reciprocating member 5 descends.

However, a tube expander having the above structure possesses the following problems.

The previously-known tube expander expands a plurality of tubes into interlocked relationship with the end plates and plurality of radiating fins.

However, when the plurality of mandrels are inserted into the plurality of tubes, friction force is generated, which may cause damage to both the tubes and mandrels.

In order to avoid the friction force of the mandrels, it is usually necessary for a worker to manually apply oil to each of the mandrels, which not only leads to extensive time loss in operating the tube expander, but also causes other serious problems such as low productivity.

SUMMARY OF THE INVENTION

The present invention solves all of the above problems even when a multitude of mandrels are inserted into a multitude of tubes by eliminating the need for manual oil application for the purpose of preventing frictional damage between the mandrels and tubes.

It is an object of the present invention to provide a tube expander with excellent operability and high productivity by offering instant and proper operation in expanding tubes.

More specifically, the tube expander of the present invention, for use in expanding tubes of a heat exchanger placed on the tube expander, the heat exchanger having a plurality of radiating fins and a plurality of such tubes inserted into the fins, comprises a plurality of tube-expanding mandrels for insertion into the tubes from one end thereof, and an oil-discharging device for discharging a predetermined amount of oil into the tubes mounted between the mandrels and tubes so as to move reciprocally in the axial direction of the tubes. The oil-discharging device comprises a plurality of oil-discharging nozzles, each of which individually includes a pipe-shaped nozzle main body having at least an expander bullet which is insertable into the tube and a discharging hole for discharging oil filled within the oil-discharging nozzle into the tube, a movable annular sleeve mounted around the circumferential surface of the main body and having a contact end part that can abut against the opening end of the tube, the sleeve being urged by a resilient member provided on either the main body of the oil-discharging nozzle or elsewhere on the oil-discharging device, the annular sleeve and nozzle main body being movable relative to each other in the axial direction of the tubes to open and close the discharging hole, and a stopper formed or otherwise provided on an end of the expander bullet to receive the sleeve on the end of the expander bullet.

In the present invention, in accordance with the above structure, as the oil-discharging device moves towards the tube, the opening end of the tube abuts against the contact end of the sleeve that encompasses the oil-discharging nozzle of the oil-discharging device. The sleeve, in abutment with the opening end of the tube, ceases movement in the axial direction of the tube, while the nozzle main body with expander bullet continues to be inserted into the tube, thus opening the discharging hole provided on the main body of the oil-discharging nozzle whereby oil contained within the oil-discharging nozzle is discharged therefrom into the tube.

As the oil-discharging nozzle retracts from the tube, the sleeve is urged towards the discharging hole by means of the resilient member to consequently close the discharging hole, whereby the sleeve stops the discharge of oil.

As such, according to the present invention, even when a multitude of mandrels are to be inserted into a multitude of tubes of the heat exchanger at the time of tube expansion, manual oil application is not a necessary step in order to prevent frictional damage between the mandrels and tubes, because at the time of operation, each oil-discharging nozzle can simply move into a tube of the heat exchanger to instantly discharge a predetermined amount of oil into the plurality of tubes. The present invention thus offers a highly productive tube expander.

These and other objects, features and advantages of the present invention will become clearer when reference is made to the following description of the preferred embodiments of the present invention, together with reference to the accompanying drawings.

DESCRIPTION OF THE PREFERRED EMBODIMENTS

Figure 1:
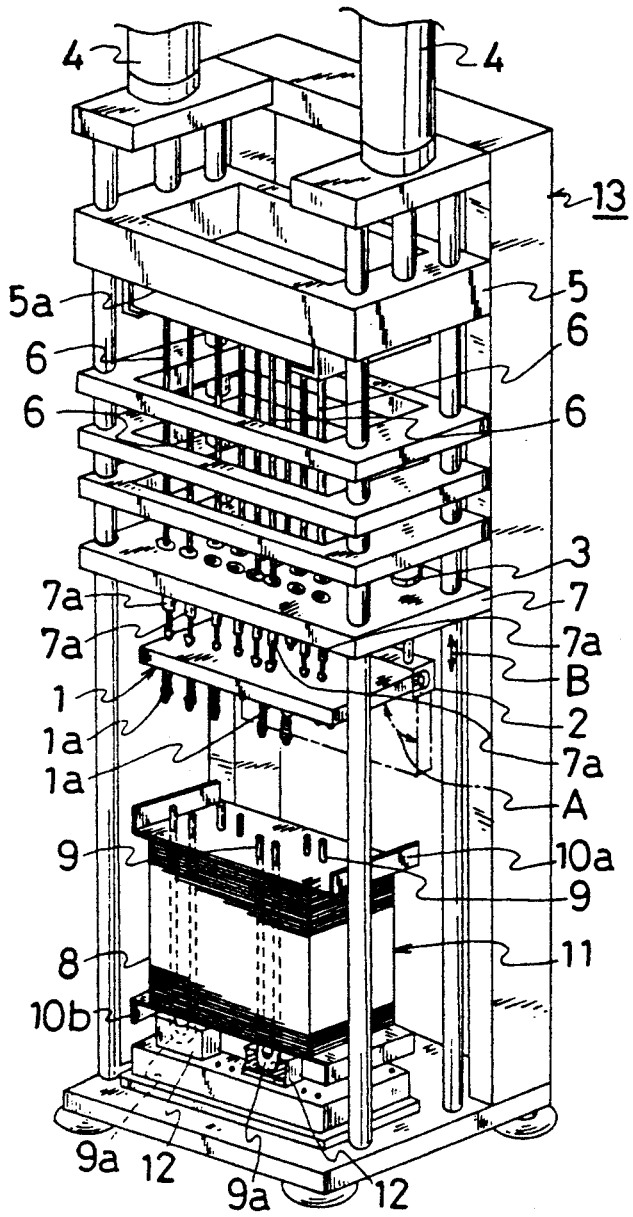
FIG. 1 is a perspective view showing a preferred embodiment of a tube expander of the present invention.

Referring now to the drawings, which are for purposes of illustrating preferred embodiments of the invention only and not for purposes of limiting the same, FIG. 1 shows an oil-discharging device 1 equipped with a plurality of oil-discharging nozzles 1*a* that discharge a predetermined amount of oil into tubes 9 of, for example, a heat exchanger 11 mounted on a tube expander 13.

Figure 2:
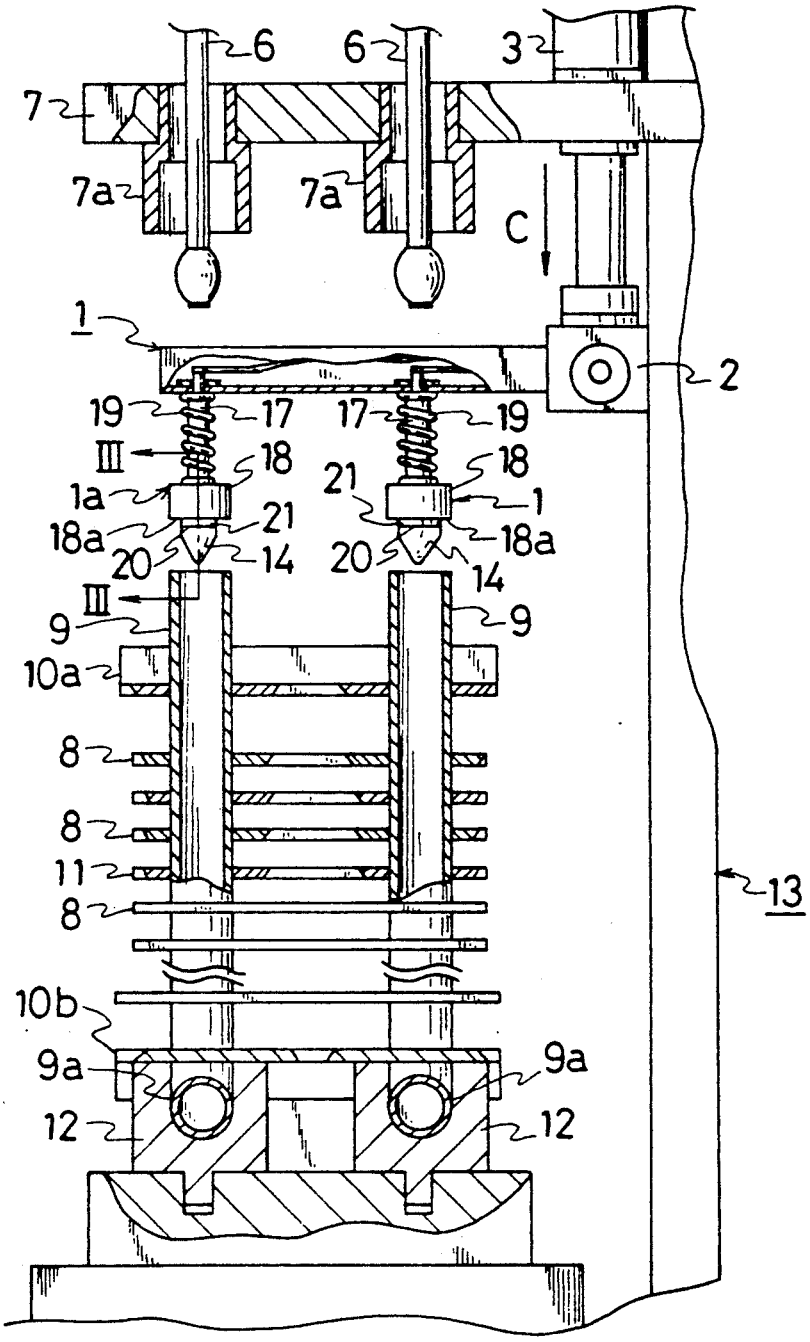
FIG. 2 is a partially cutaway side view showing a pre-use condition of the oil-discharging device of the present invention.
Figure 3:
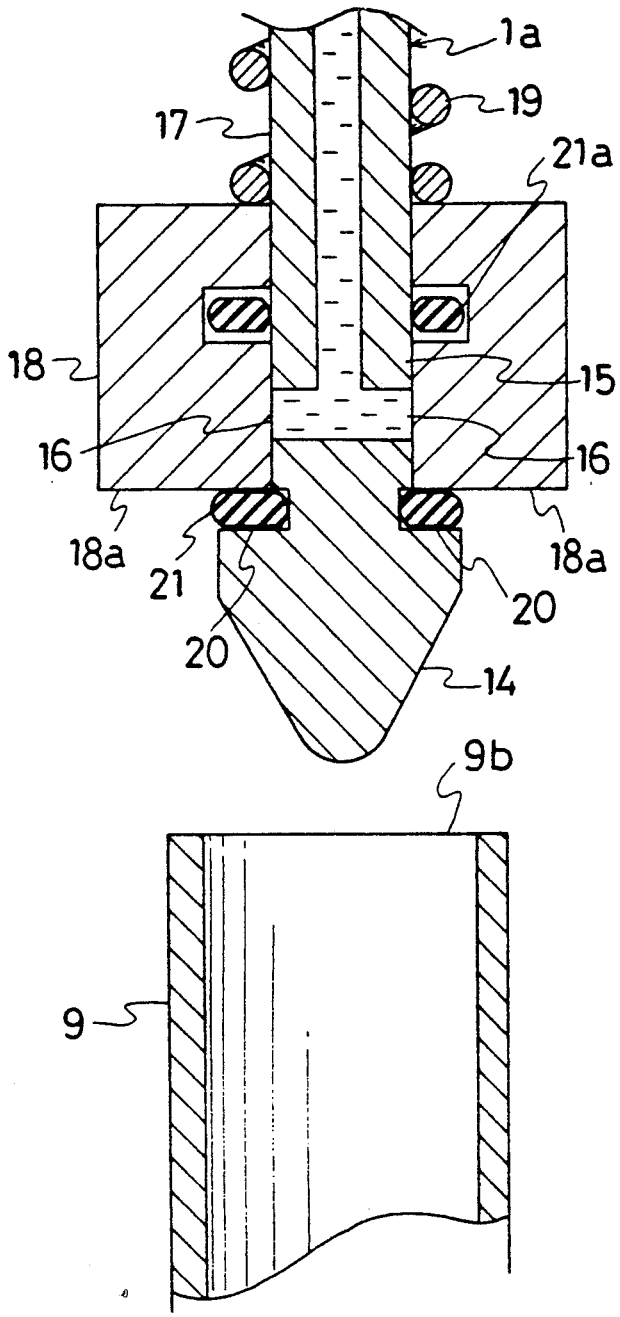
FIG. 3 is an enlarged section view taken along line III—III of FIG. 2.

As shown in FIGS. 2 and 3, each oil-discharging nozzle 1*a* of the oil-discharging device 1 includes a substantially conical expander bullet 14 to be inserted into the tube 9 formed at the end of a pipe-shaped main body 17 of a discharging nozzle 15 having a discharging hole 16 to discharge oil filled within the discharging nozzle 15. A movable annular sleeve 18, which is arranged around the circumferential surface of main body 17, has a contact end part 18*a* to abut against opening end 9*b* of the tube 9, sleeve 18 circumferentially surrounding the main body 17 and being urged toward the expander bullet 14 of main body 17 by resilient spring member 19 to close the discharging hole 16. An annular stopper 20 is formed on an upper surface of the expander bullet in the main body 17 to receive sleeve 18 on the upper surface of the expander bullet, a ring packing 21 being housed within a space between the annular stopper 20 and the sleeve 18, and a ring packing 21*a* being housed inside the sleeve 18 around the circumferential surface of main body 17, respectively, for preventing oil-leakage.

As shown in FIG. 1, a rotary actuator 2 rotates the oil-discharging device 1 in the direction of the arrow A above the heat exchanger 11 so that the device 1 can be pivoted into and out of a space provided above the heat exchanger 11.

A hydraulic cylinder 3 is provided on a stripper plate 7 of the tube expander 13 so that the rotary actuator 2 can be moved in the direction of the arrow B, the axial direction of tubes 9 which penetrate heat exchanger 11.

Now that the structure of the tube expander according to a first embodiment of the invention has been described, the mechanism of expanding the tubes of the heat exchanger using such a device will be described.

Figure 4:
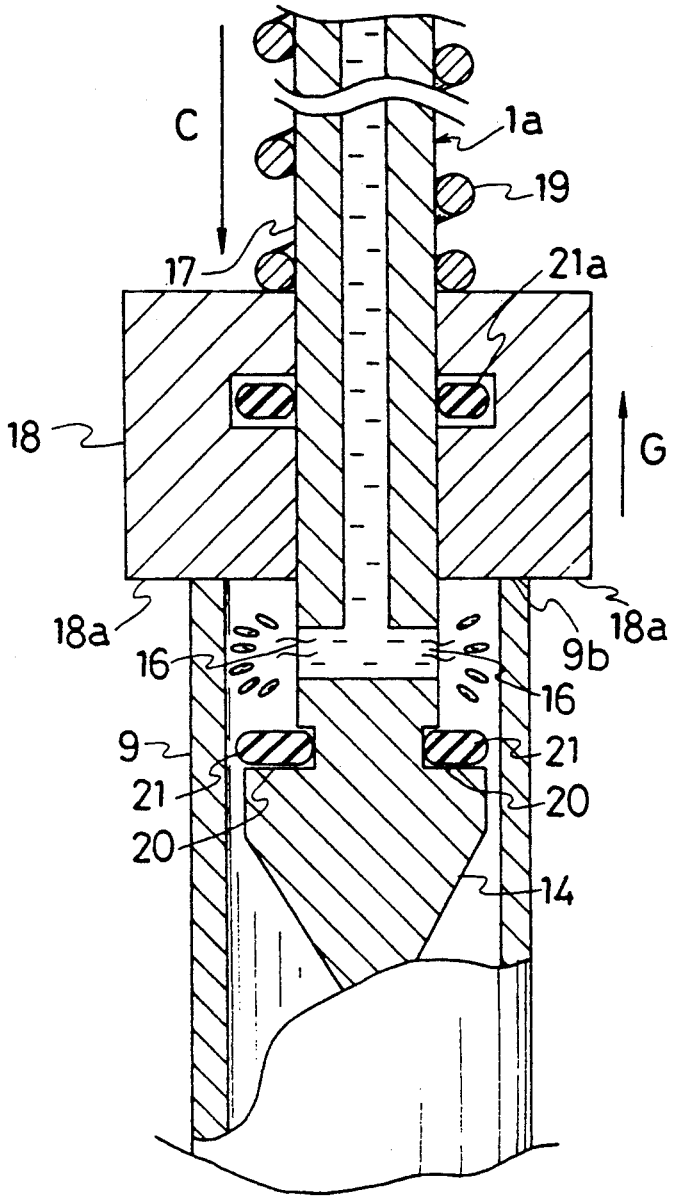
FIG. 4 is a partially-enlarged section view showing a condition in which the oil-discharging nozzle of the tube expander of the present invention is used.

First, as shown in FIG. 4, when the hydraulic cylinder 3 mounted on the rotary actuator 2 is extended in the direction of the arrow C, each of the oil-discharging nozzles 1*a* of the oil-discharging device 1 provided on rotary actuator 2 is moved towards and inserted into a tube 9 arranged within heat exchanger 11.

Then, as the oil-discharging device moves towards and into the tube 9, the opening end 9*b* of tube 9 comes in contact with the contact end part 18*a* of the sleeve 18 that surrounds the oil-discharging nozzle 1*a* of oil-discharging device 1.

Thereafter, the sleeve 18 remains in contact with the opening 9*b* of the tube 9 while expander bullet 14 and main body 17 move in the direction of the arrow G so as to open the discharging hole 16 mounted on the main body 17 of oil-discharging nozzle 1*a* as the oil-discharging device 1 moves into the tube 9.

The oil filled within the oil-discharging nozzle 1*a* is discharged through the discharging hole 16 of the oil-discharging nozzle la as the expander bullet 14 and main body 17 move to open the hole, as a result of which oil is applied to the inner wall of the tube 9 to facilitate the insertion of a mandrel 6.

Figure 5:
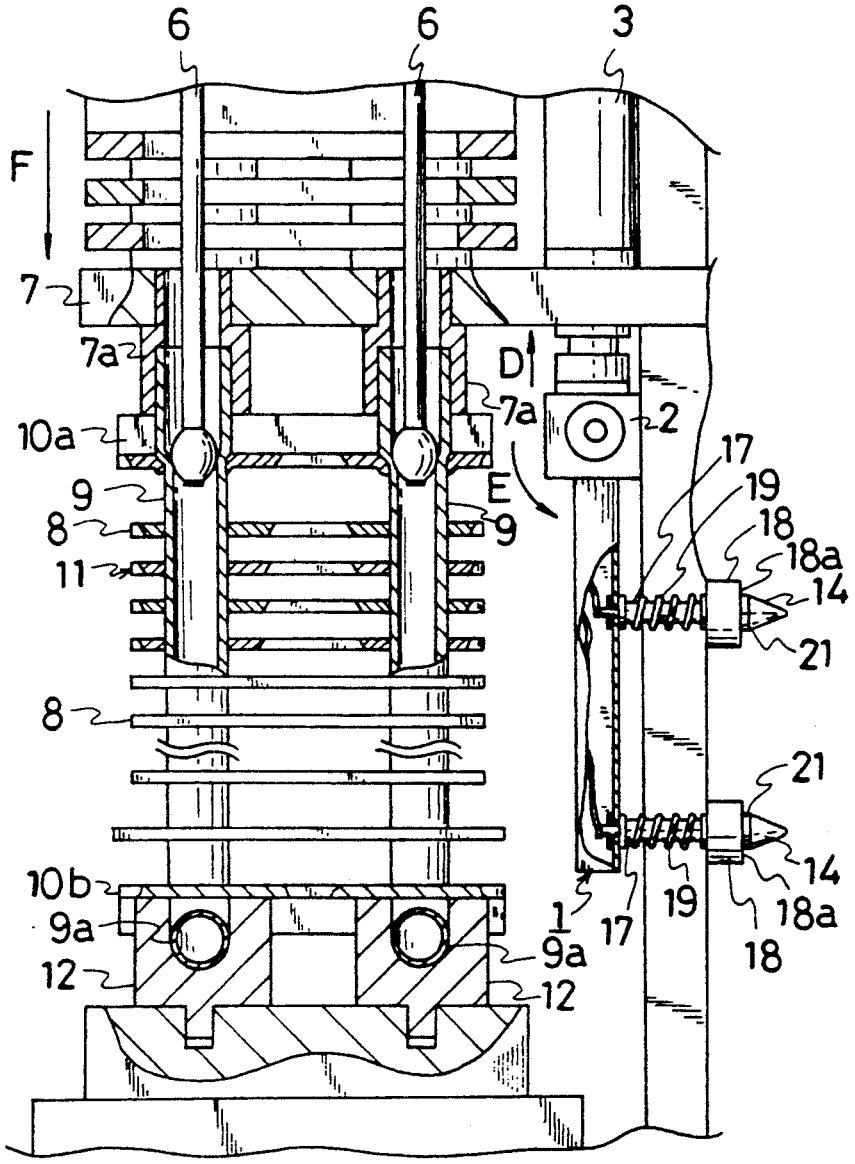
FIG. 5 is a partially cutaway side view of the tube expander of the present invention in action.

After that, as shown in FIG. 5, the hydraulic cylinder 3 is contracted in the direction of the arrow D, and then the rotary actuator 2 is driven to be rotated in the direction of the arrow E to pivotally withdraw the oil-discharging device 1 mounted on rotary actuator 2 from the space provided above the heat exchanger 11.

The tube 9 of the heat exchanger 11 can now be expanded without a complicated manual oiling operation by moving the tube expander 13 in the direction of the arrow F after the withdrawal of the oil-discharging device 1 from the space provided above the heat exchanger 11.

In the above embodiment, the oil-discharging device is arranged to enter into the space provided above the heat exchanger or exit therefrom by means of the rotary actuator 2 mounted on the hydraulic cylinder 3 provided on the stripper plate 7, but as long as it is mounted to freely move in and out between the tube expander mandrels 6 and the heat exchanger tubes 13, it need not be mounted as one unit with the air cylinder or servo motor mechanism that stretches or retracts the oil-discharging device relative to heat exchanger 11, or with the stripper plate 7 for that matter.

Moreover, in the above embodiment, while the oil-discharging nozzles provided on the oil-discharging device are arranged in parallel in the front and back of the tube expander, the present invention is not limited to this particular configuration, and can include any mechanism wherein oil-discharging nozzles are attached or removed to match a variety of arrangement patterns of tubes inserted into a heat exchanger to be expanded.

Furthermore, the circumferential surface of the oil-discharging nozzle is surrounded by annular movable sleeve 18 and ring packings 21 and 21*a* so as to prevent oil-leakage thereof in such a way that they are urged toward the expander bullet 14 of the oil-discharging nozzle by means of resilient member 19 so as to close the oil-discharging hole 16 mounted on the oil-discharging nozzle when not in use. During operation, the oil-discharging nozzle is moved into the tube of the heat exchanger to open the discharging hole from a closed state when the movable sleeve 18 abuts against opening end 9*b* of the tube and is moved out of the tube to close the discharging hole when the oiling operation is completed.

Figure 6:
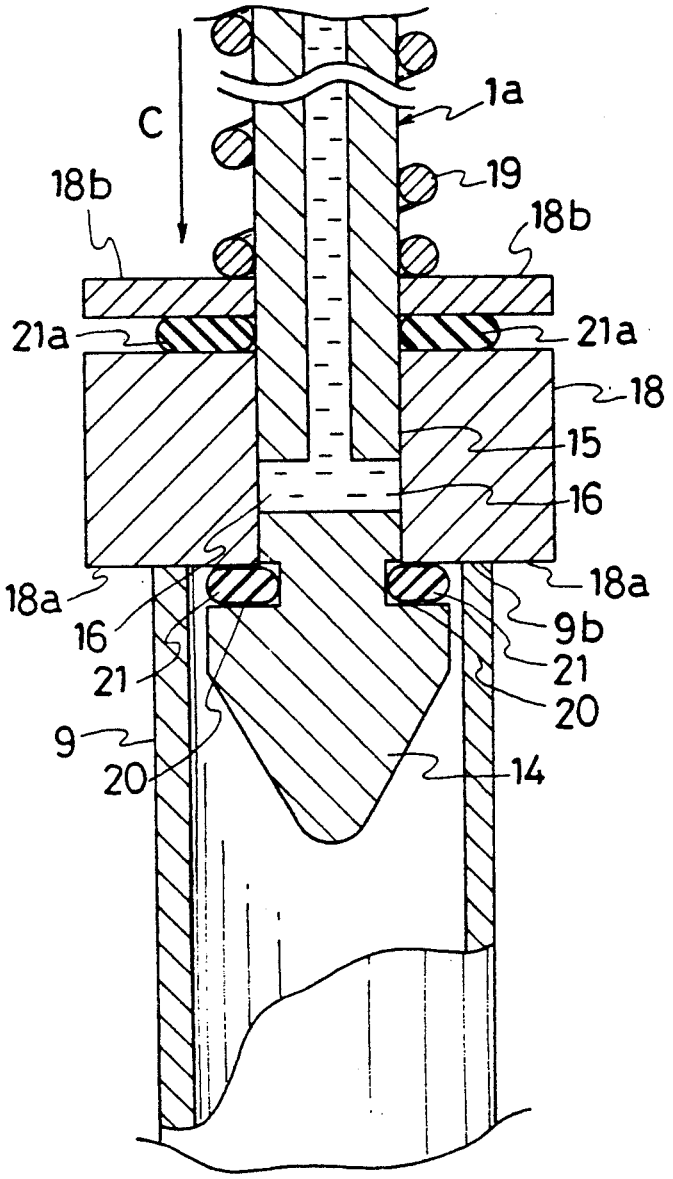
FIG. 6 is an enlarged section view showing another embodiment of the oil-discharging nozzle of the tube expander of the present invention.
Figure 7:
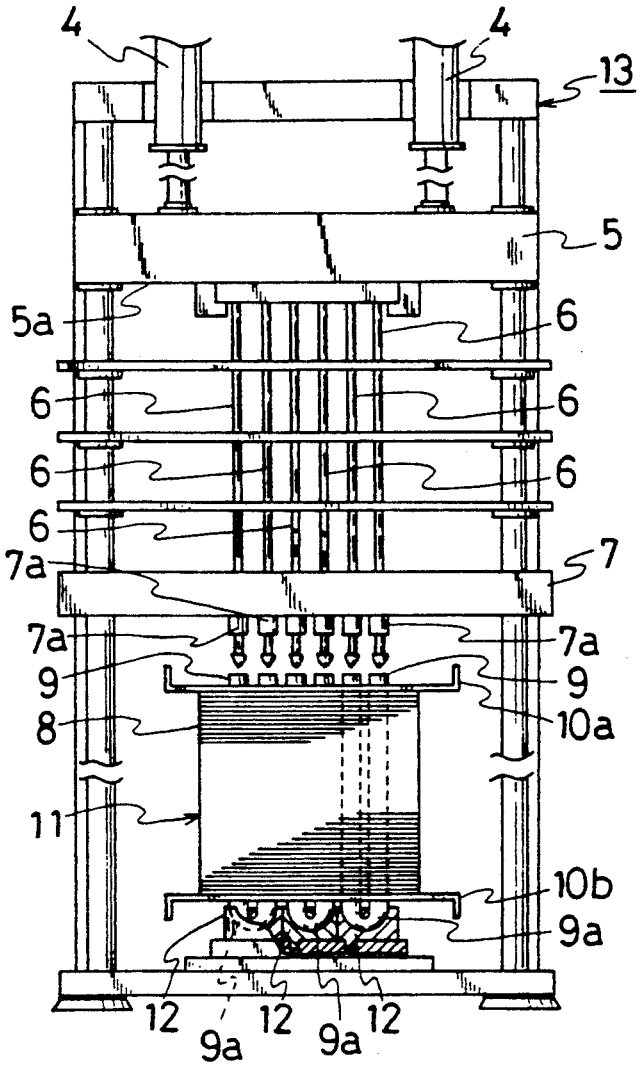
FIG. 7 PRIOR ART
FIG. 7 is a front view of a conventional tube expander.

In an alternative embodiment of the present invention, as shown in FIG. 6, ring packing 21*a* can be positioned between two annular and movable sleeves 18 and 18*b*.

The oil-discharging device, the oil-discharging nozzle mounted on the oil-discharging device, and the moving means that makes the oil-discharging device freely enter into or exit from the space between the tube of the heat exchanger and the mandrel inserted therein at the time of tube expansion are not necessarily limited to the above embodiments with respect to their shape, quantity and mechanism. In other words, as long as the oil-discharging device that facilitates the insertion of the mandrel by discharging a predetermined amount of oil into the tube is movably mounted, its specific configuration can be varied within the scope of the present invention.

What is claimed is:

1. A tube expander for expanding tubes of a heat exchanger arranged on the tube expander, the heat exchanger having a plurality of radiating fins and a plurality of said tubes inserted into said fins, the tube expander comprising a plurality of tube-expanding mandrels for insertion into said tubes from one end thereof, and an oil-discharging device for discharging a predetermined amount of oil into said tubes mounted between said mandrels and tubes for reciprocal movement in an axial direction of said tubes, said oil-discharging device having a plurality of oil-discharging nozzles each individually including a movable pipe-shaped nozzle main body having an expander bullet for insertion into one of said tubes and a discharging hole for discharging oil filled within said oil-discharging nozzle into said one tube, a movable annular sleeve arranged around a circumferential surface of said nozzle main body, said annular sleeve and nozzle main body being movable relative to each other in the axial direction of said tubes for opening and closing said discharging hole, said annular sleeve having a contact part for abutting against an end opening of said one tube, a resilient member provided on said oil-discharging device for urging said contact part of said annular sleeve against said end opening of said one tube, and a stopper provided on an end of said expander bullet for receiving said sleeve on said end of said expander bullet.

2. A tube expander in accordance with claim 1, wherein said resilient member is provided on said main nozzle body.

3. A tube expander in accordance with claim 1, further comprising means removably mounting said oil-discharging nozzle on said oil-discharging device.

4. A tube expander in accordance with claim 1, further comprising packing means arranged on said nozzle main body of said oil-discharging nozzle for preventing oil leakage from said oil-discharging hole when said oil-discharging hole is closed.

5. A tube expander in accordance with claim 3, further comprising packing means arranged on said nozzle main body of said oil-discharging nozzle for preventing oil leakage from said oil-discharging hole when said oil-discharging hole is closed.

6. A tube expander in accordance with claim 1, further comprising a stripper plate arranged for reciprocal movement in the axial direction of said tubes, said oil-discharging device being mounted on said stripper plate.

7. A tube expander in accordance with claim 3, further comprising a stripper plate arranged for reciprocal movement in the axial direction of said tubes, said oil-discharging device being mounted on said stripper plate.

8. A tube expander in accordance with claim 4, further comprising a stripper plate arranged for reciprocal movement in the axial direction of said tubes, said oil-discharging device being mounted on said stripper plate.

9. A tube expander in accordance with claim 6, further comprising a rotary actuator for moving said oil-discharging device into or out of a space between said mandrels and tubes.

10. A tube expander in accordance with claim 7, further comprising a rotary actuator for moving said oil-discharging device into or out of a space between said mandrels and tubes.

11. A tube expander in accordance with claim 8, further comprising a rotary actuator for moving said oil-discharging device into or out of a space between said mandrels and tubes.

12. A tube expander in accordance with claim 9, further comprising a cylinder mounted on said stripper plate for moving said rotary actuator reciprocally in the axial direction of said tubes.

13. A tube expander in accordance with claim 10, further comprising a cylinder mounted on said stripper plate for moving said rotary actuator reciprocally in the axial direction of said tubes.

14. A tube expander in accordance with claim 11, further comprising a cylinder mounted on said stripper plate for moving said rotary actuator reciprocally in the axial direction of said tubes.

15. A tube expander in accordance with claim 1, further comprising extending means for moving said oil-discharging device in a direction crossing the axial direction of said tubes.

16. A tube expander in accordance with claim 15, wherein said extending means comprises a cylinder.

* * * * *